US007007404B2

(12) United States Patent
Gagnon

(10) Patent No.: US 7,007,404 B2
(45) Date of Patent: Mar. 7, 2006

(54) HEATING ELEMENT ASSEMBLY FOR CLOTHES DRIER

(75) Inventor: Sylvain Gagnon, Sherbrooke (CA)

(73) Assignee: ISE Stamping Inc., Bromptonville (CA)

( * ) Notice: Subject to any disclaimer, the term of this patent is extended or adjusted under 35 U.S.C. 154(b) by 0 days.

(21) Appl. No.: 10/868,769

(22) Filed: Jun. 17, 2004

(65) Prior Publication Data

US 2005/0000112 A1 Jan. 6, 2005

Related U.S. Application Data

(60) Provisional application No. 60/478,819, filed on Jun. 17, 2003.

(51) Int. Cl.
*F26B 11/02* (2006.01)

(52) U.S. Cl. ..... 34/132

(58) Field of Classification Search ..... 34/132, 34/603, 607, 134; 174/138 J; 219/532
See application file for complete search history.

(56) References Cited

U.S. PATENT DOCUMENTS

D27,756 S 10/1897 Graham
889,040 A 5/1908 Porter
1,155,593 A 10/1915 Mansbridge
1,555,268 A 9/1925 Colby
1,813,767 A 7/1931 Reichart
2,673,889 A * 3/1954 Metz ..... 174/138 J
2,835,048 A * 5/1958 Olthuis et al. ..... 34/132
2,844,703 A 7/1958 Prather
3,111,571 A 11/1963 De Camp
4,243,872 A * 1/1981 Best ..... 219/532
4,268,742 A 5/1981 Cottrell et al.
4,700,495 A * 10/1987 Drews et al. ..... 34/603

* cited by examiner

*Primary Examiner*—Kenneth Rinehart
(74) *Attorney, Agent, or Firm*—Ogilvy Renault LLP

(57) ABSTRACT

A heating element assembly for a clothes drier, comprising: a heating wire coil adapted to be wired to a power source for heating air passing through a heating element housing of a drier for subsequent drying of clothes in a drum of the drier. The heating wire coil has straight portions intermittently positioned between coil portions. Support members are adapted to be secured to the heating element housing in a predetermined pattern for supporting the straight portions of the heating wire coil while preventing displacement of the coil portions, so as to retain the heating wire coil on the heating element housing.

6 Claims, 3 Drawing Sheets

HEATING ELEMENT ASSEMBLY FOR CLOTHES DRIER

CROSS-REFERENCE TO RELATED APPLICATION

This patent application claims priority on U.S. Provisional Patent Application No. 60/478,819, filed on Jun. 17, 2003.

BACKGROUND OF THE INVENTION

1. Field of the Invention

The present invention relates to clothes driers and, more specifically, to a heating element assembly for a clothes drier.

2. Background Art

In a typical clothes drier, warm air is conveyed through a rotating drum accommodating wet clothes so as to cause the moisture in the wet clothes to evaporate. The rotating drum is provided with vanes to entrain the clothes in a tumbling action, thereby fully exposing the clothes to the warm air.

Before being drawn to the rotating drum, air is passed through a heating element. A typical heating element assembly of a clothes drier is illustrated at 10 in FIG. 1 of the prior art. The heating element assembly 10 has a heating wire coil 11 (e.g., consisting of standard nichrome wire), forming a semi-circular shape. The coil 11 is circumferentially held in a housing 12, by a plurality of hoops 13 through which the coil 11 passes. The housing 12 forms a plenum with a rear end of the drum of the drier, through which air is drawn to reach the drum. In doing so, air passes across the coil 11 and is hence heated by the coil 11.

The coil 11 of the heating element assembly 10 of the prior art tends to migrate downwardly through the combined effects of gravity and thermal expansion and contraction. As air passes across the coil 11 in its entirety, the downward migration of the coil 11 results in an inefficient heat exchange between the coil 11 and the air passing therethrough. The upper portion of the coil 11 will also be exceedingly stretched, which may lead to a shortened life for the coil 11. Moreover, the installation and replacement of the coil 11 is a lengthy procedure in which the coil 11 must be threaded through each one of the hoops 13.

SUMMARY OF INVENTION

It is therefore an aim of the present invention to provide a novel heating element assembly.

It is a further feature of the present invention to provide a heating element assembly that substantially overcomes the disadvantages of the prior art.

Therefore, in accordance with the present invention, there is provided a heating element assembly for a clothes drier, comprising a heating wire coil adapted to be wired to a power source for heating air passing through a heating element housing of a drier for subsequent drying of clothes in a drum of the drier, the heating wire coil having straight portions intermittently positioned between coil portions, and support members adapted to be secured to the heating element housing in a predetermined pattern for supporting the straight portions of the heating wire coil while preventing displacement of the coil portions, so as to retain the heating wire coil on the heating element housing.

Further in accordance with the present invention there is provided a heating element assembly for a clothes drier, comprising a housing having at least one foldable tab, a heating wire coil for heating air passing through the housing for subsequent drying of clothes in a drum of the drier, and a support member for retaining a portion of the heating wire coil onto the housing, the support member having a tab receiving portion in which the at least one foldable tab is abutted to secure the support member to the housing.

Still further in accordance with the present invention, there is provided a heating wire coil for a heating element assembly of a clothes drier, comprising coil portions, straight portions intermittently positioned between the coil portions, the straight portions each being adapted to be received in supports on a housing of a heating element assembly of a clothes drier while confining the coil portions to space between the supports, and terminal ends adapted to be connected to a power source for heating the heating wire coil.

BRIEF DESCRIPTION OF THE DRAWINGS

Having thus generally described the nature of the invention, reference will now be made to the accompanying drawings, showing by way of illustration a preferred embodiment thereof and in which.

DESCRIPTION OF THE PREFERRED EMBODIMENTS

Figure 1:
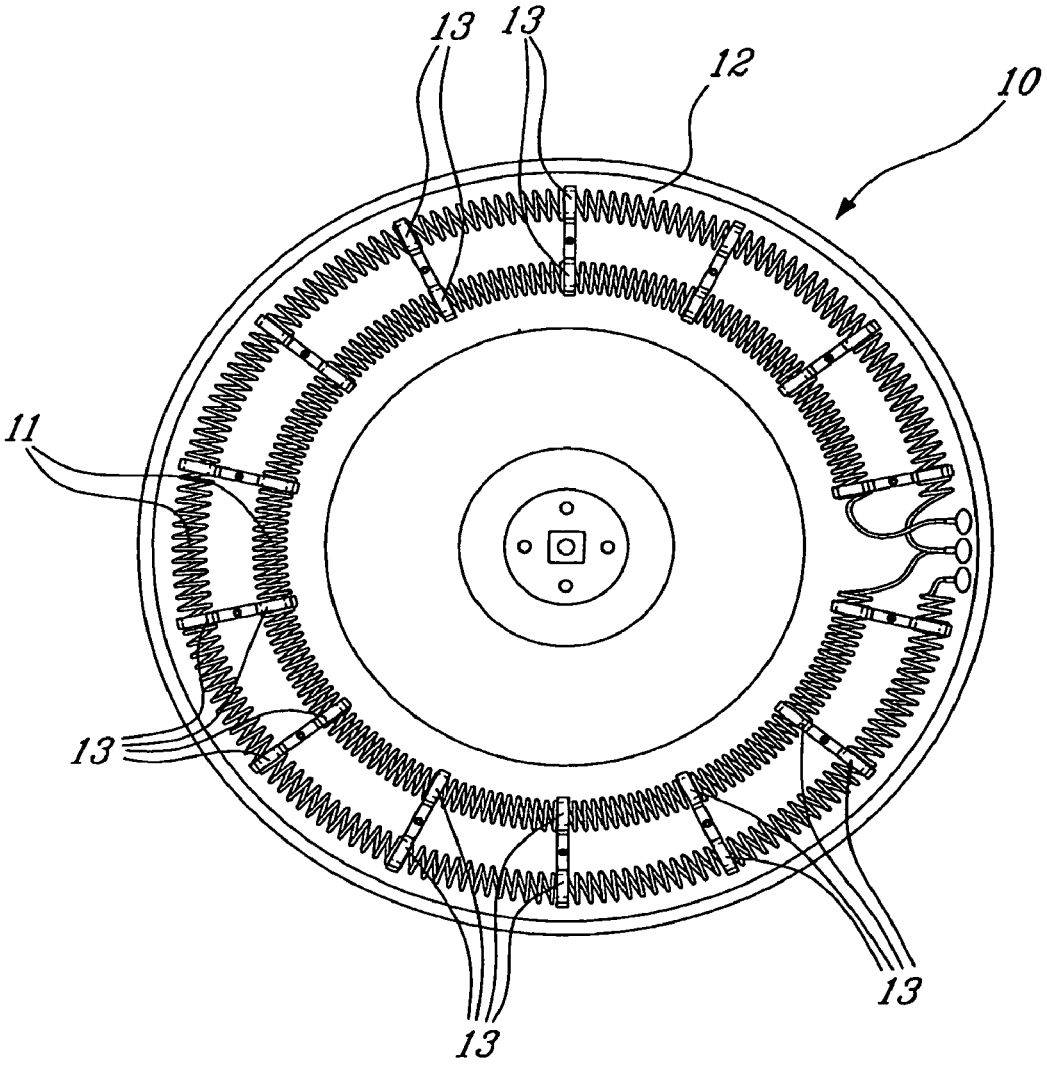
Fig-1 (PRIOR ART)
FIG. 1 is a front elevation view of a heating element assembly constructed in accordance with the prior art.
Figure 2:
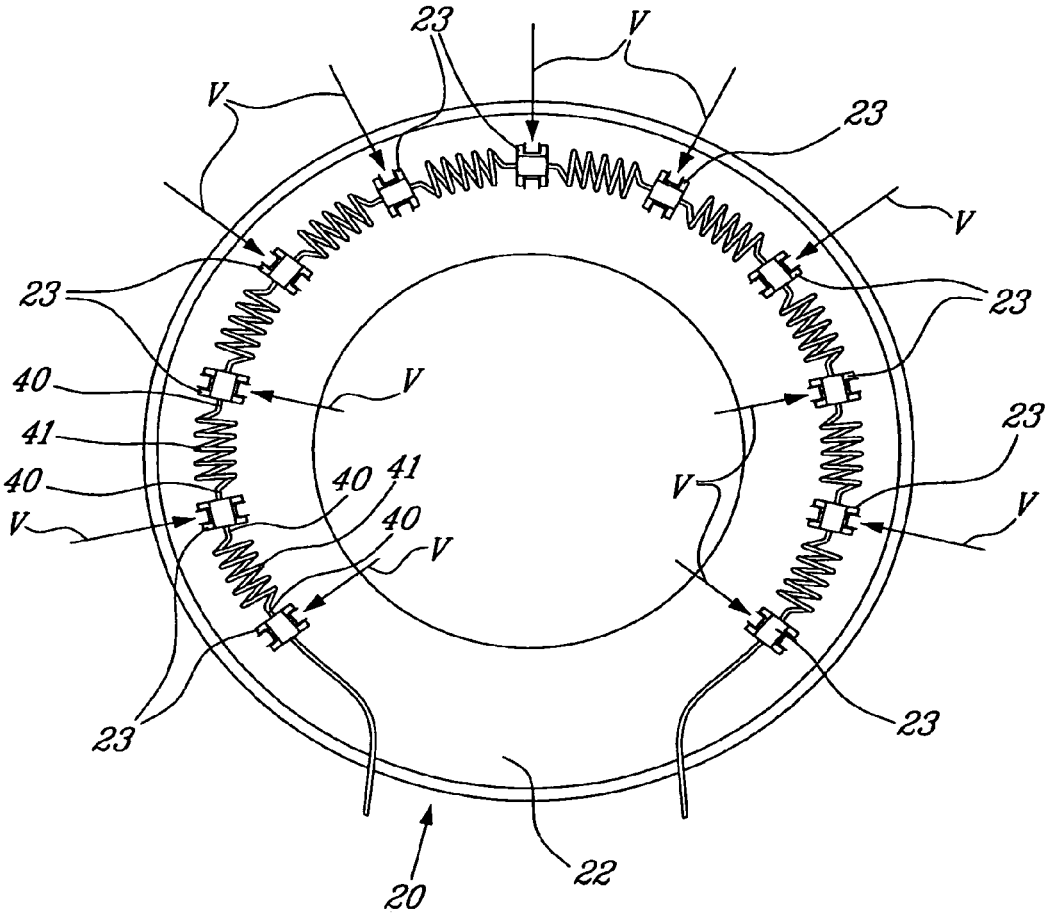
FIG. 2 is a front elevation view of a heating element assembly in accordance with a preferred embodiment of the present invention.

Referring now to the drawings and, more particularly to FIG. 2, a heating element assembly in accordance with the present invention is generally shown at 20. The heating element assembly has a heating wire coil 21, that is wired to a power source for being heated. The heating wire coil 21 is circumferentially positioned on a housing 22. The coil 21 is supported by a plurality of support members 23.

Figure 3:
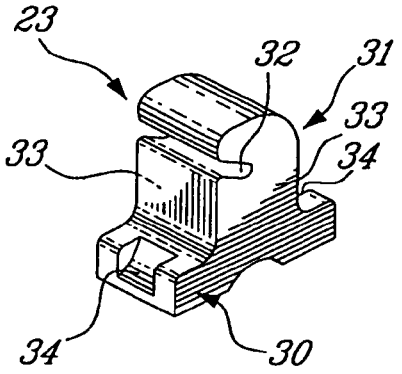
FIG. 3 is a perspective view of a support member for a heating wire coil, of the heating element assembly of the present invention.

Referring to FIG. 3, one of the support members 23 is shown in greater detail. The support member 23 has a base portion 30. A hook portion 31 extends outwardly from the base portion 30. A slot 32 is adjacent to an end of the hook portion 31, and extends between lateral surfaces 33 of the support member 23. Grooves 34 are provided in the base portion 30. The support members 23 are made of an insulating material, such as ceramic.

Figure 4:
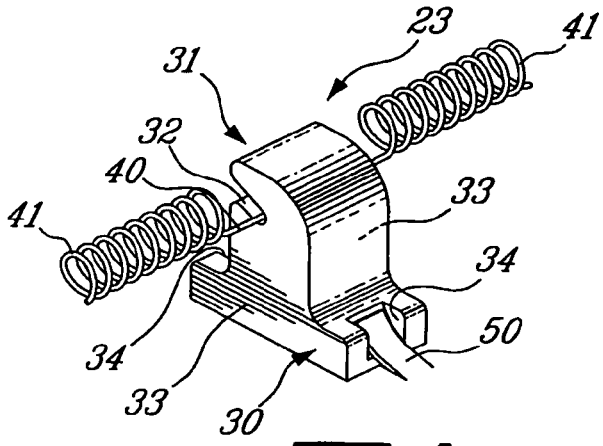
FIG. 4 is a perspective view of the support member supporting a portion of the heating wire coil.

Referring to FIG. 4, the heating wire coil 21 has intermittent straight portions, such as that illustrated by 40, between coil portions 41. The intermittent straight portion 40 is fitted in the slot 32 of the support member 23. The slot 32 is sized so as to snuggly receive the intermittent straight portion 40, but also to prevent the coil portion 41 to pass therethrough. Accordingly, the coil portions 41 will be confined to staying within opposed lateral surfaces 33 of adjacent support members 23. This will prevent any downward migration of the heating wire coil 21.

It is pointed out that the slot 32 may have other shapes. For instance, the slot 32 may define more of a hook portion, to further reduce the risk of dislodgment of the heating wire coil 21 from the slot 32.

It is appreciated that the above described configuration of the heating wire coil 21 and support members 23 lends itself to automated assembly. Referring to FIG. 2, it is preferred that the slots 32 of some of the support members 23 face alternating opposed directions, as illustrated by V, to enhance the retention of the heating wire coil 21 within the assembly 20. The support members 23 supporting the upper portion of the coil 21 will have the slots 32 facing upwardly, to oppose against gravity. It is also contemplated to have all the slots 32 facing outwardly, considering that the coil 21 is extended once positioned onto the housing 22.

Figure 5A:
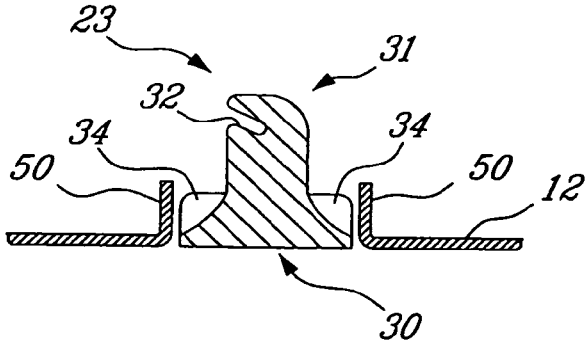
FIG. 5A is a cross-section view of the support member prior to being secured to a housing of the heating element assembly of the present invention.
Figure 5B:
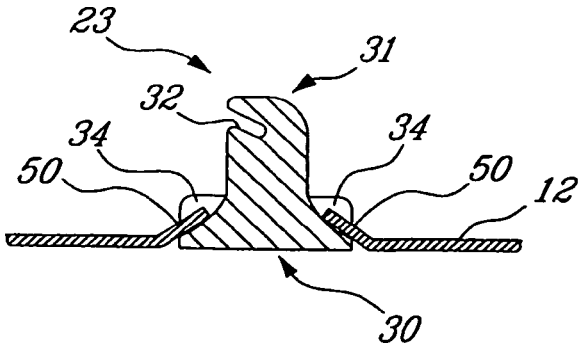
FIG. 5B is a cross-section view of the support member being secured to the housing of the heating element assembly of the present invention.

Referring to FIGS. 5A and 5B, tabs 50 are provided in the housing 22, and are strategically placed where the support members 23 will be positioned. The tabs 50 will be folded into the grooves 34 of the support member 23, so as to retain the support member 23 in position onto the housing 22. It is pointed out that a single tab 50 may be provided by support member 23, provided that the single tab 50 exerts enough pressure to retain the support member 23 onto the housing 22. It is appreciated that the tab/groove configuration is preferred as it will facilitate the assembly of the support members 23 onto the housing 22.

What is claimed is:

1. A heating element assembly for a clothes drier, comprising:

a heating wire coil adapted to be wired to a power source for heating air passing through a heating element housing of a drier for subsequent drying of clothes in a drum of the drier, the heating wire coil having straight portions intermittently positioned between coil portions; and support members adapted to be secured to the heating element housing in a predetermined pattern for supporting the straight portions of the heating wire coil while preventing displacement of the coil portions, so as to retain the heating wire coil on the heating element housing, the support members each having a body having a pair of lateral surfaces, a slot being defined in the body between the lateral surfaces so as to accommodate one of the straight portions of the heating wire coil, the slot being sized such that coil portions of the heating wire coil are retained opposite lateral surfaces of adjacent ones of the support members when the straight portions are in the slots, and being open to a surface transverse to the lateral surfaces and defining a hook shape in the lateral surfaces, such that the straight portion of the heating wire coil is held captive in the slot.

2. The heating element assembly according to claim 1, wherein each of the support members has at least one tab receiving cavity adapted to receive a tab from a housing of the clothes drier, so as to be secured to the housing.

3. A heating element assembly for a clothes drier, comprising:

a housing having at least one foldable tab;

a heating wire coil for heating air passing through the housing for subsequent drying of clothes in a drum of the drier; and support members for retaining a portion of the heating wire coil onto the housing, each of the support members having a tab receiving portion in which the at least one foldable tab is abutted to secure the support member to the housing, each of the support members having a slot being perpendicular to a pair of lateral surfaces of the support member, the slot being sized such that coil portions of the heating wire coil are retained between opposite lateral surfaces of adjacent ones of the support member when straight portions of the heating wire coil intermittently positioned between the coil portions are in the slots.

4. The heating element assembly according to claim 3, wherein the slot is open to a surface of the support member transverse to the lateral surfaces and defines a hook shape in the lateral surfaces, such that the straight portion of the heating wire coil is held captive in the slot.

5. The heating element assembly according to claim 5, wherein the support members are positioned on the housing such that openings to the slots are in a selected orientation to retain the straight portions of the heating wire coil in the support members.

6. The heating element assembly according to claim 3, wherein the tab receiving portion is a groove in the support member in which the at least one foldable tab is accommodated when folded.

* * * * *